United States Patent [19]

Foley et al.

[11] 4,123,266

[45] Oct. 31, 1978

[54] SINTERED HIGH PERFORMANCE METAL POWDER ALLOY

[75] Inventors: Edward M. Foley, Russiaville; Dennis G. Dreyer, Kokomo; Herbert E. Rogers, Jr., Sharpsville, all of Ind.

[73] Assignee: Cabot Corporation, Kokomo, Ind.

[21] Appl. No.: 870,917

[22] Filed: Jan. 19, 1978

Related U.S. Application Data

[63] Continuation of Ser. No. 344,753, Mar. 26, 1973, abandoned.

[51] Int. Cl.[2] ..... B22F 3/00

[52] U.S. Cl. ..... 75/244; 75/246; 75/200; 75/202; 75/171

[58] Field of Search ..... 75/246, 200, 202, 244, 75/171

[56] References Cited

U.S. PATENT DOCUMENTS

| | | | |
|---|---|---|---|
| 2,746,860 | 5/1956 | Binder et al. | 75/171 |
| 2,996,379 | 8/1961 | Faulkner | 75/171 |
| 3,035,934 | 5/1962 | Cape | 75/171 |
| 3,362,816 | 1/1968 | Winter et al. | 75/171 |

OTHER PUBLICATIONS

Westerman, "Sintering of Nickel-Base Superalloys", Transactions AIME, vol. 224, 1962, pp. 159–164.

*Primary Examiner*—Brooks H. Hunt
*Attorney, Agent, or Firm*—Jack Schuman; Joseph J. Phillips

[57] ABSTRACT

Articles of high performance chromium-containing cobalt-base alloys sintered from powder contain boron in amounts between about 0.1 and 1.0%. The addition of boron widens the range of sintering temperatures sufficiently to make possible commercial production of articles of compositions which otherwise are difficult or impossible to sinter.

10 Claims, 1 Drawing Figure

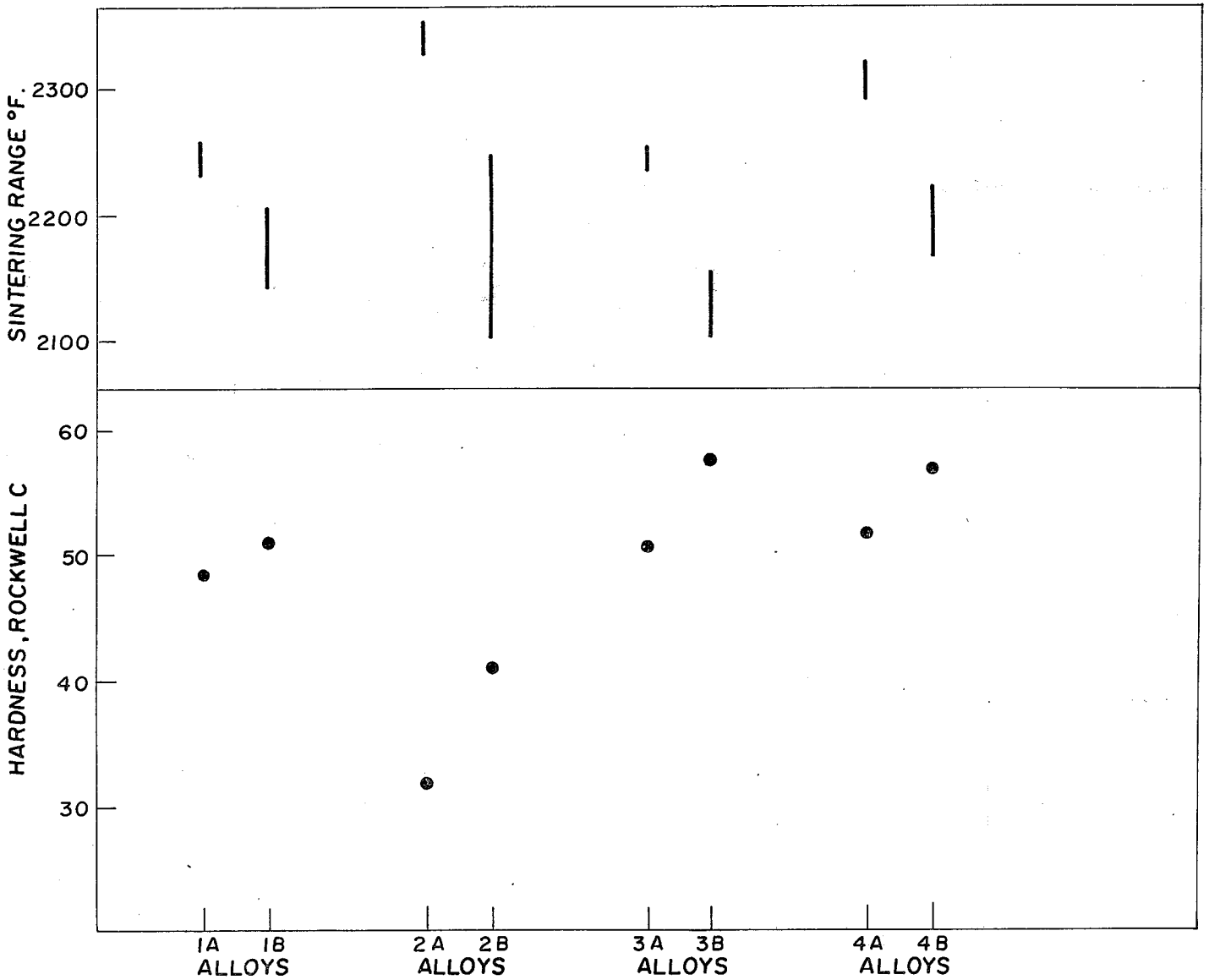
SINTERING RANGE °F.
2300
2200
2100
HARDNESS, ROCKWELL C
60
50
40
30
1A ALLOYS
1B ALLOYS
2A ALLOYS
2B ALLOYS
3A ALLOYS
3B ALLOYS
4A ALLOYS
4B ALLOYS

SINTERED HIGH PERFORMANCE METAL POWDER ALLOY

This is a continuation of application Ser. No. 344,753 filed Mar. 26, 1973 now abandoned.

This invention relates to sintered articles of high performance metal alloy powder, and the process of making them. It is more particularly concerned with such articles produced from cobalt-base boron-containing alloys.

The alloys of which the articles of our invention are composed are high-performance chromium-containing cobalt-base alloys resistant to wear, heat and corrosion. These alloys either are not workable or are worked with difficulty, and are commonly produced as castings which may be ground or machined when necessary. Many small articles made from these high-performance alloys, such as thread guides for textile mills, valve seat inserts, and the like, are tedious and expensive to cast in the quantities and configurations that are required. Attempts have been made to produce such articles by powder metallurgical processes, such as by slip casting or pressing the articles to shape from fine powder and then sintering them. However those processes, which have proved to be satisfactory and economical for many alloys, have been found difficult to adapt to the production of articles of high-performance alloys of compositions previously known.

It is a requirement that the sintered high performance alloys here mentioned have maximum hardness available from their compositions, and densities, approaching that of a cast article. In practice this meand densities upwards of 95% of cast density. Prior to our invention to be described articles of cobalt-base alloys having these maximized properties could be obtained only by sintering the articles at a temperature approaching the liquidus temperature of the alloy, in a range so narrow that commercial production of sintered articles was very difficult to achieve.

Those skilled in the metallurgical art know that the melting of alloy powder compacts is not a single event which occurs when the liquidus temperature of the alloy is reached, unless the alloy is the eutectic composition. Melting of a portion of the compact constituting an alloy of the eutectic composition will first occur, at a temperature which is lower than the liquidus temperature of the alloy as a whole. Thereafter, the composition of the molten portion will change as its temperature increases and corresponding additional amounts of the alloy constituents melt. We refer to sintering in this range as liquid-phase sintering to distinguish it from sintering under conditions at or below the eutectic melting point which is called solid-phase sintering.

It is an object of our invention therefore to provide articles of chromium-containing cobalt base high-performance alloys of a composition which sinters over a wider range of temperatures than those known to the prior art. It is another object to provide such articles having densities approaching cast density, and high hardness. It is another object to provide such articles of improved homogeneity. It is still another object to provide a commercially feasible process of manufacturing those articles. Other objects of our invention will become evident from the description thereof which follows.

In the past, experiments have been carried out in which various alloy powders incorporating boron were sintered. Metal powders tend to oxidize on their surfaces and it was thought that those oxide films on the power particles inhibited their coalescence during sintering. It was postulated that boron would react with those surface oxides to form volatile oxides of boron, which would be driven off. Boron was added as metallic boron in amounts of 0.05 to 0.07% and as zirconium diboride in amounts from 0.2% to 0.4%. It was found that in relatively oxygen-free powder the additions had little effect. In powders of high oxide content the boron and diboride additions brought about increases in the density of sintered articles and in some cases reduction of sintering temperature. However, the sintering was carried out at temperatures close to the liquidus temperature of the alloy and in about half the samples the density was 99.5% or greater of cast density, which in most powder metallurgical applications is considered excellent. For the cobalt-base alloy used in the experiments a 0.4% zirconium diboride addition was considered to be less beneficial than an 0.2% addition. These experiments are described in technical documentary report N. R. AMFL-TR65-257 of Aug. 15, 1965, titled "Final Report On Complex Shapes By Slip Casting", published by United States Air Force, Wright Patterson Air Force Base, Ohio.

It is also disclosed in U.S. Pat. No. 3,035,934 issued to Arthur T. Cape, on May 22, 1962 and captioned "Application of Cobalt Base Alloys To Metal Parts", that the melting point of cobalt-base chromium-containing powder can be depressed so as to facilitate its flame spraying by mixing the powder with a powdered cobalt-boron alloy. The preferred boron content of the mixed powder was between 1.6% and 2.6% by weight.

We have found that certain cobalt-base high-performance alloy powders containing boron in amounts between about 0.1% and 1% sinter to high hardness and high density over temperature ranges considerably wider than were known heretofore. In this way sintered articles can be made from compositions that without boron are not sinterable at all, or are only marginally sinterable. We prefer to adjust the nominal boron content of our alloys to about 0.5%, or within a restricted range of about 0.3% to about 0.7%.

Actual contents in experimental examples, shown in Table II, range from 0.43% to 0.56% boron or rounded out to about 0.4 to 0.6% boron. Thus, the preferred content of "about 0.5% boron" may be defined as "about 0.4% to 0.6%."

Typical compositions of four high-performance alloys of our invention are listed in the accompanying Table I. They are high-carbon cobalt-base alloys containing chromium and tungsten as their principal alloying constituents, together with boron. Articles of these alloys are made by powder metallurgical processes which include consolidating and solid-phase sintering metal powder of the specified composition. The articles can be formed by slip-casting, which involves no consolidation, followed by sintering, but we prefer to consolidate the powder by pressing the articles in dies or the like prior to sintering. This reduces the shrinkage which inevitably accompanies sintering, and makes it easier to produce articles to restricted dimensional tolerances.

TABLE I

| Alloy | Cr | Mo | W | C | Alloying Elements B | Ni | Si | Fe | Mn | Co |
|---|---|---|---|---|---|---|---|---|---|---|
| 1 | 29.0 | — | 11.0 | 2.00 | 0.1– | 3.0* | 1.0* | 3.04 | 1.0* | Bal. |
| | 33.0 | | 14.0 | 2.70 | 1.0 | | | | | |
| 2 | 27.0 | | 3.5 | 0.90 | 0.1– | | | | | |
| | 31.0 | 1.50* | 5.5 | 1.40 | 1.0 | 3.0* | 1.5* | 3.0* | 1.0* | Bal. |
| 3 | 24.0 | — | 13.0 | 3.00 | 0.1– | | | | | |
| | 28.0 | | 15.0 | 3.50 | 1.0 | 3.0* | 1.0* | 5.0* | 1.0* | Bal. |
| 4 | 31.0 | — | 16.0 | 2.20 | 0.1– | | | | | |
| | 34.0 | | 19.0 | 2.70 | 1.0 | 2.5* | 1.0* | 3.0* | 1.0* | Bal. |

*Maximum
Balance includes incidental impurities.

The alloy powder which we employ is preferably produced by the atomization of a melt of the desired composition. This melt is heated to a temperature of 200° F. or so above its fusion temperature in a crucible. Preferably, this melting is carried out in vacuum or under a blanket of inert gas such as argon. The melt is then poured into a preheated refractory tundish which is fashioned with a small-diameter nozzle in the bottom through which the stream of metal flows into an atomizing chamber. The stream emerging from the nozzle is broken up into fine particles by a high-pressure jet of inert gas, or of water, which makes contact with the molten stream just below the nozzle. The particles or droplets are almost instantaneously quenched by the atomizing fluid and fall into a reservoir in the bottom of the atomizing chamber. Only the fraction is used which passes through a 30 mesh screen. These particles are approximately spherical in shape and about 25% to 35% of the particles are −325 mesh.

We then blend or mix the powder with a solid binder and a solvent. We prefer to use polyvinyl alcohol as a binder for our powder, but other solid binders which are known to the art are employed. Examples are camphor, methyl alcohol, paradichlorobenzene, chloroacetic acid, napthalene, benzoic acid, phthalic anhydride, glycerine, Acrowax C which is a proprietary compound, the ethylene oxide polymers sold as Carbowax, synthetic gums such as acrylamide, and metal stearates. The solvent for the binder must be appropriately chosen. Water is satisfactory for water-soluble binders.

The blending of the powder and binder particles is accomplished in any suitable mixing apparatus. The amount of binder is not critical, and a few percent by weight is sufficient. The plastic or putty-like blend of particles, binder and solvent is then consolidated into agglomerates, preferably by extrusion, but other methods, such as roll briquetting, may be employed.

The extrusions are dried, crushed in a roller crusher, hammer mill or the like, and screened. The −100 mesh fraction of crushed extruded bindered powder is largely fines. From about 60% to 80% of the particles are −325 mesh with corresponding apparent densities of about 2.0 to 3.3 grams per cc. Both the percentage of fines and the apparent density of this material are, however, less than those of the atomized powder.

The agglomerates of powder and binder are pressed in dies or molds of the desired shape under a pressure of about 50 tons per sq. inch. The compacting pressure can be as low as 20 tons per sq. inch or as high as 70 tons per sq. inch, the density of the green compacts being higher at higher compaction pressures. At a compaction pressure of 20 tons per sq. inch, compact density is about 56 to 58% of cast density, and at 70 tons per sq. inch it is 70 to 72% of cast density.

A finished article of the desired density is obtained by liquid-phase sintering the compact in vacuum or reducing atmosphere. Sintering can be completed in about an hour but if the time is extended to 2 or at most 3 hours the temperature can be reduced somewhat without impairing the properties of the article. Compacts properly sintered have densities of 98% or better of cast density.

Our process also contemplates grinding, when necessary, of part or all of the powder particles resulting from the atomization of a melt as above described. We grind −30 mesh atomized powder by ball milling, impact milling, attriting, vibrating milling, or other known process so as to convert it to particles more than 98% of which are −325 mesh and process those particles in the way described above to produce sintered articles having improved properties. The milling vehicle which we prefer to use is methanol, the mill is preferably evacuated to minimize oxidation of the charge, and, in the case of ball milling, the balls charged are made of a wear-resistant alloy compatible with the product being produced. Milling time ranges from about 8 to 36 hours and the average particle size of the −325 mesh product ranges from about 30 microns to as low as 9 microns, depending on milling conditions. After milling, the charge is dumped from the mill and the powder allowed to settle. The alcohol is decanted and the sludge is vacuum filtered. The powder filter cake is allowed to dry under vacuum or in air.

Specimens of each of the four alloys listed in Table I were prepared in the manner which has been described herein, but with various boron contents. These specimens, their sintering temperature ranges, and their properties are listed in Table II. The composition of each specimen is otherwise that of the like numbered alloy in Table I.

TABLE II

| Alloy | Boron Content-Percent By Weight | Sintering Temperature Range—° F. | Hardness-Rockwell C | Minimum Density-% of Cast Alloy |
|---|---|---|---|---|
| 1 A | 0.24 | 2230 – 2260 | 52–53 | 97 |
| 1 B | 0.43 | 2140 – 2210 | 54–55 | 97 |
| 2 A | 0.018 | 2330 – 2350 | 38–41 | 98 |
| 2 B | 0.54 | 2100 – 2240 | 45–48 | 98 |
| 3 A | 0.023 | 2230 – 2250 | 34–55 | 99 |
| 3 B | 0.46 | 2100 – 2160 | 59–61 | 98 |
| 4 A | 0.02 | 2290 – 2320 | 54–57 | 97 |
| 4 B | 0.56 | 2170 – 2220 | 59–60 | 98 |

It will be observed that the specimens of the alloys with quite low boron contents, 2A, 3A and 4A, have to be sintered in very narrow temperature ranges. Alloys 2A and 3A have sintering temperature ranges of only 20° F. Such a restricted range makes the commercial production of sintered articles quite different even with elaborate temperature control of the sintering furnaces.

Alloy 1A, with 0.25% boron, had a sintering temperature range of 30° and alloy 1B with 0.43% boron had a sintering range of 70°. Alloys 2B, 3B and 4B, each with about ½% boron, had sintering ranges of 140°, 60°, and 50°, respectively. It is not difficult to hold the sintering temperature within ranges of this order. It will also be noted that the hardness of alloys 1B, 2B, 3B and 4B was higher than the hardness of their companion alloys 1A, 2A, 3A and 4A, respectively, which have lower boron contents.

The experimental results tabulated above are plotted in the attached figure. The lower sintering temperatures, wider sintering ranges and higher hardness values of alloys 1B, 2B, 3B and 4B, which are the alloys of our invention, are apparent.

In the foregoing specification we have described a presently preferred embodiment of this invention, however, it will be understood that this invention can be otherwise embodied within the scope of the following claims.

We claim:

1. An article of liquid-phase sintered metal powder consisting of chromium from about 24% to 34%, tungsten from about 3.5% to about 20%, carbon from about 0.08% to about 3.5%, silicon up to about 1.5%, manganese up to about 1%, iron up to about 5%, nickel up to about 3.0%, boron about 0.43% to about 0.56%, molybdenum up to about 1.5%, and the balance cobalt and incidental impurities, said boron present to provide a wider sintering temperature range of the metal powder.

2. An article of claim 1 containing about 29% to about 33% chromium, about 11% to about 14% tungsten, about 2% to about 2.7% carbon, up to about 1% silicon, up to about 1% iron, and about 0.43% boron.

3. An article of claim 1 containing about 27% to about 31% chromium, about 3.5% to 5.5% tungsten, about 0.9% to about 1.4% carbon, up to about 3% iron, and about 0.54% boron.

4. An article of claim 1 containing about 24% to about 28% chromium, about 13% to about 15% tungsten, about 3% to about 3.5% carbon, up to about 1% silicon, and about 0.46% boron.

5. An article of claim 1 containing about 31% to about 34% chromium, about 16% to about 19% tungsten, about 2.2% to 2.7% carbon, up to about 2.5% nickel, up to about 3% iron, and about 0.56% boron.

6. In a process for the production of a dense article from high performance cobalt-base alloy powder including the steps of consolidating the powder under pressure into an article of the desired shape and then sintering that article, the improvement comprising incorporating boron in the powder in an amount about 0.43% to about 0.56% by weight thereby providing a wider sintering temperature range, and liquid-phase sintering the article at a temperature between the solidus and liquidus temperature of the alloy.

7. The process of claim 6 in which the alloy consists of about 0.43% boron, about 29% to about 33% chromium, about 11% to about 14% tungsten, about 2.0% to about 2.7% carbon, up to about 3% nickel, up to about 1% silicon, up to about 3% iron, up to about 1% manganese and the balance cobalt and incidental impurities.

8. The process of claim 6 in which the alloy consists of about 0.54% boron, about 27% to about 31% chromium, about 3.5 % to about 5.5% tungsten, about 0.9% to about 1.4% carbon, up to about 3% nickel, up to about 1.5% silicon, up to about 3% iron, up to about 1% manganese, up to about 1.5% molybdenum and the balance cobalt and incidental impurities.

9. The process of claim 6 in which the alloy consists of about 0.46% boron, about 24% to 28% chromium, about 13% to about 15% tungsten, about 3% to about 3.5% carbon, up to about 3% nickel, up to about 1% silicon, up to about 5% iron, up to about 1% manganese and the balance cobalt and incidental impurities.

10. The process of claim 6 in which the alloy consists of about 0.56% boron, about 31% to about 34% chromium, about 16% to about 19% tungsten, about 2.2% to about 2.7% carbon, up to about 2.5% nickel, up to about 1% silicon, up to about 3% iron, up to about 1% manganese and the balance cobalt and incidental impurities.

* * * * *